US006088844A

United States Patent [19]

Killham

[11] Patent Number: 6,088,844

[45] Date of Patent: Jul. 18, 2000

[54] DRAIN STOPPER

[76] Inventor: Larry R. Killham, 4733 Belinder Rd., Westwood, Kans. 66205

[21] Appl. No.: 09/204,469

[22] Filed: Dec. 3, 1998

[51] Int. Cl.[7] ..... E03D 1/26; A47K 1/14

[52] U.S. Cl. ..... 4/295; 4/287

[58] Field of Search ..... 4/287, 292, 295, 4/651, 652, 680, 688

[56] References Cited

U.S. PATENT DOCUMENTS

| | | | |
|---|---|---|---|
| 438,465 | 10/1890 | Blessing | 4/287 |
| 2,597,399 | 5/1952 | Steele | 4/287 |
| 3,380,081 | 4/1968 | Eilertson | 4/295 |

*Primary Examiner*—John Fox

[57] ABSTRACT

A drain stopper for not invoking as much fear in animals as do traditional holed drains when the animals are placed in a sink or tub for bathing. The drain stopper includes an outer housing that has a lower portion and a peripheral sidewall that extends from the lower portion. The outer housing is adapted for insertion in a drain hole. The peripheral sidewall of the outer housing has a plurality of slots extending through it. A lid is coupled to the outer housing. The lid has an upper surface which is textured for helping reduce slipping of skin along the lid. A generally round screen portion is disposed between the lower portion of the outer housing and an inner sidewall of the lid.

16 Claims, 2 Drawing Sheets

DRAIN STOPPER

BACKGROUND OF THE INVENTION

1. Field of the Invention

The present invention relates to drain plugs and more particularly pertains to a new drain stopper for plugging a drain while not invoking as much fear in animals as do traditional holed drains when the animals are placed in a sink or tub for bathing.

2. Description of the Prior Art

The use of drain plugs is known in the prior art. More specifically, drain plugs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,996,279; U.S. Pat. No. 2,094,286; U.S. Pat. No. Des. 319,295; U.S. Pat. No. 5,486,287; U.S. Pat. No. 4,207,631; and U.S. Pat. No. 3,982,289.

While these devices fulfill their respective, particular objectives and requirements, the aforementioned patents do not disclose a new drain stopper. The inventive device includes an outer housing that has a lower portion and a peripheral sidewall that extends from the lower portion. The outer housing is adapted for insertion in a drain hole. The peripheral sidewall of the outer housing has a plurality of slots extending through it. A lid is coupled to the outer housing. The lid has an upper surface which is textured for helping reduce slipping of skin along the lid. A generally round screen portion is disposed between the lower portion of the outer housing and an inner sidewall of the lid.

In these respects, the drain stopper according to the present invention substantially departs from the conventional concepts and designs of the prior art, and in so doing provides an apparatus primarily developed for the purpose of not invoking as much fear in animals as do traditional holed drains when the animals are placed in a sink or tub for bathing.

SUMMARY OF THE INVENTION

In view of the foregoing disadvantages inherent in the known types of drain plugs now present in the prior art, the present invention provides a new drain stopper construction wherein the same can be utilized for not invoking as much fear in animals as do traditional holed drains when the animals are placed in a sink or tub for bathing.

The general purpose of the present invention, which will be described subsequently in greater detail, is to provide a new drain stopper apparatus and method which has many of the advantages of the drain plugs mentioned heretofore and many novel features that result in a new drain stopper which is not anticipated, rendered obvious, suggested, or even implied by any of the prior art drain plugs, either alone or in any combination thereof.

To attain this, the present invention generally comprises an outer housing that has a lower portion and a peripheral sidewall that extends from the lower portion. The outer housing is adapted for insertion in a drain hole. The peripheral sidewall of the outer housing has a plurality of slots extending through it. A lid is coupled to the outer housing. The lid has an upper surface which is textured for helping reduce slipping of skin along the lid. A generally round screen portion is disposed between the lower portion of the outer housing and an inner sidewall of the lid.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new drain stopper apparatus and method which has many of the advantages of the drain plugs mentioned heretofore and many novel features that result in a new drain stopper which is not anticipated, rendered obvious, suggested, or even implied by any of the prior art drain plugs, either alone or in any combination thereof.

It is another object of the present invention to provide a new drain stopper which may be easily and efficiently manufactured and marketed.

It is a further object of the present invention to provide a new drain stopper which is of a durable and reliable construction.

An even further object of the present invention is to provide a new drain stopper which is susceptible of a low cost of manufacture with regard to both materials and labor, and which accordingly is then susceptible of low prices of sale to the consuming public, thereby making such drain stopper economically available to the buying public.

Still yet another object of the present invention is to provide a new drain stopper which provides in the apparatuses and methods of the prior art some of the advantages thereof, while simultaneously overcoming some of the disadvantages normally associated therewith.

Yet another object of the present invention is to provide a new drain stopper which includes an outer housing that has a lower portion and a peripheral sidewall that extends from the lower portion. The outer housing is adapted for insertion in a drain hole. The peripheral sidewall of the outer housing has a plurality of slots extending through it. A lid is coupled to the outer housing. The lid has an upper surface which is textured for helping reduce slipping of skin along the lid. A generally round screen portion is disposed between the lower portion of the outer housing and an inner sidewall of the lid.

Still yet another object of the present invention is to provide a new drain stopper that does not invoke as much fear in animals as do traditional holed drains when the animals are placed in a sink or tub for bathing. It is common in animals to be afraid of allowing a paw to slip into a depression in a surface. This fear makes bathing animals, especially pets, very difficult. However, the flat upper surface and cylindrical shape of the drain stopper are designed not to invoke such fears in animals. The flat upper surface gives the appearance of being part of the sink basin. The animal will be less fearful to position its paws on or near the drain stopper.

Even still another object of the present invention is to provide a new drain stopper that has a textured upper surface so that the pet does not slip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
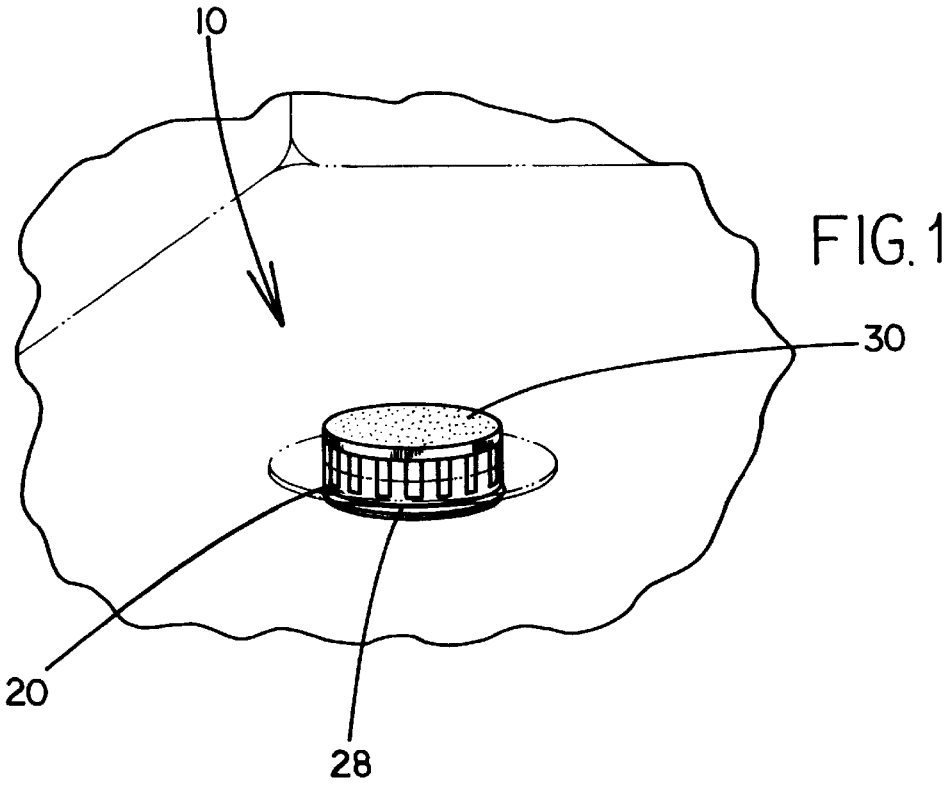
FIG. 1 is a schematic perspective view of a new drain stopper according to the present invention.
Figure 2:
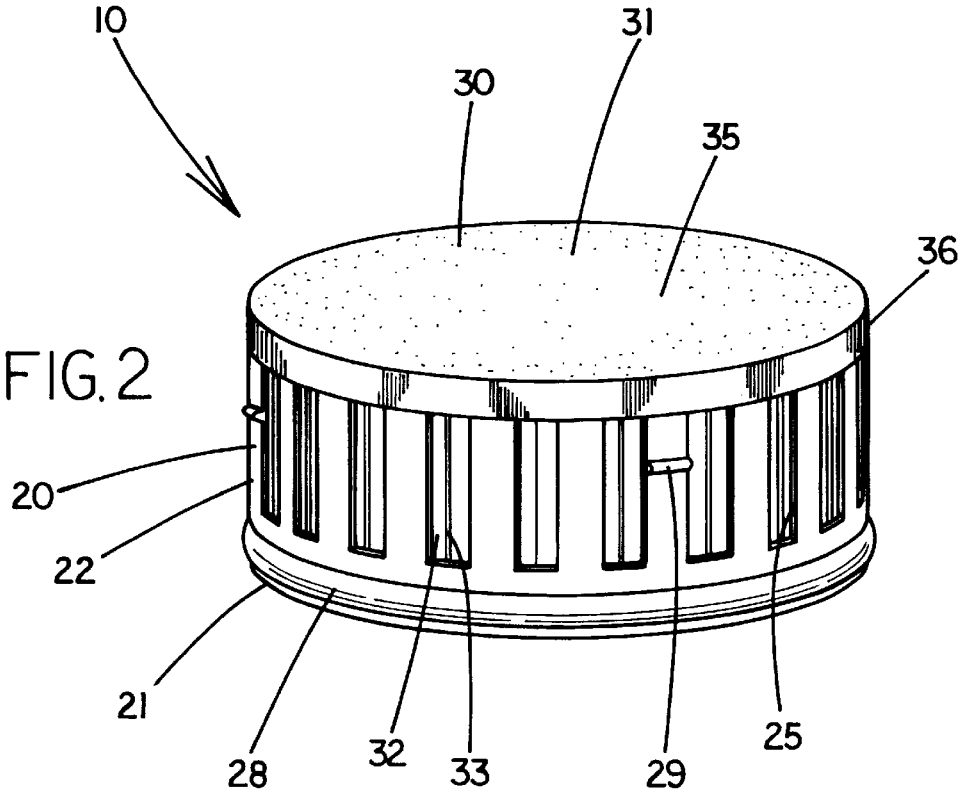
FIG. 2 is a schematic perspective view of the present invention.

With reference now to the drawings, and in particular to FIGS. 1 through 4 thereof, a new drain stopper embodying the principles and concepts of the present invention and generally designated by the reference numeral 10 will be described.

As best illustrated in FIGS. 1 through 4, the drain stopper 10 generally comprises an outer housing 20 that has a lower portion 21 and a peripheral sidewall 22 that extends from the lower portion 21. The outer housing 20 is adapted for insertion in a drain hole. The peripheral sidewall 22 of the outer housing 20 has a plurality of slots 25 extending through it. A lid 30 is coupled to the outer housing 20.

Preferably, the lower portion 21 of the outer housing 20 is generally annular and the peripheral sidewall 22 of the outer housing 20 is generally cylindrical. The outer housing 20 also has top and bottom ends 23,24 and an axis that extends between the top and bottom ends 23,24.

Also preferably, the peripheral sidewall 22 of the outer housing 20 has a plurality of uniformly spaced elongate slots 25 extending through it. Preferably, each of the slots 25 is generally rectangular and is oriented generally parallel the axis of the outer housing 20.

Preferably, the lid 30 has a top portion 31 has an inner sidewall 32 downwardly extending from the top portion 31. The inner sidewall 32 of the top portion 31 is slidably inserted in the peripheral sidewall 22 of the outer housing 20. More preferably, the top portion 31 is generally circular and the inner sidewall 32 is generally cylindrical. The lid 30 is rotatable with respect to the outer housing 20 about the axis of the outer housing 20.

The inner sidewall 32 of the lid 30 has a plurality of elongate apertures 33 extending through it. Ideally, each of the apertures 33 is generally rectangular and about the same size and shape as the slots 25 of the outer housing 20.

The apertures 33 of the inner sidewall 32 of the lid 30 are generally alignable with the slots 25 of the peripheral sidewall 22 of the outer housing 20. Rotation of the lid 30 with respect to the outer housing 20 selectively aligns and misaligns the apertures 33 and the slots 25 so that the drain stopper 10 can be positioned completely open for maximum drainage, closed for substantially no drainage, or at any position between open and closed. This is especially useful when bathing pets because the amount of misalignment can be set to catch hair and other debris removed from the pet during the bath.

Preferably, the peripheral sidewall 22 of the outer housing 20 has a groove 26 that extends around an inner surface thereof. The inner sidewall 32 of the lid 30 has a peripheral lip 34 that extends around it. The groove 26 of the outer housing 20 receives the lip 34 of the lid 30 to releasably hold the outer housing 20 and the lid 30 together.

Also preferably, the lower portion 21 of the outer housing 20 has a channel 27 extending therein around an outer surface thereof. An O-ring 28 extends around the lower portion 21 of the outer housing 20. The O-ring 28 is disposed in the channel 27 of the lower portion 21 of the outer housing 20. The O-ring 28 is adapted to form a seal with a drain hole.

Preferably, the peripheral sidewall 22 of the outer housing 20 has a plurality of flanges 29 extending from it that are adapted to limit the extent to which the outer housing 20 extends into the drain hole. Ideally, four flanges 29 extend from the outer housing 20.

A height of the outer housing 20 is defined between the top and bottom ends 23,24 thereof. Preferably, each of the flanges 29 is positioned less than about ½ of the height of the outer housing 20 from the top end 23 of the outer housing 20. This positioning keeps the top portion 31 of the lid 30 exposed so that it may be grasped to remove the drain stopper 10 from the drain without having the lid 30 exposed so much that an animal would be afraid to step on it.

Preferably, the top portion 31 of the lid 30 has an upper surface 35. The upper surface 35 is textured to help reduce slipping of skin along the top portion 31.

Preferably, an outer peripheral edge 36 of the top portion 31 of the lid 30 lies substantially on a plane that extends along an outer surface of the peripheral sidewall 22 of the outer housing 20 such that the top portion 31 substantially extends across the diameter of the drain hole. This is so that little space between the drain stopper 10 and drain hole is visible. Because there appears to be nothing that an animal's paw could slip into, an animal placed in a sink or tub with the drain stopper 10 in the drain hole would not be afraid to stand in the sink or tub.

Figure 3:
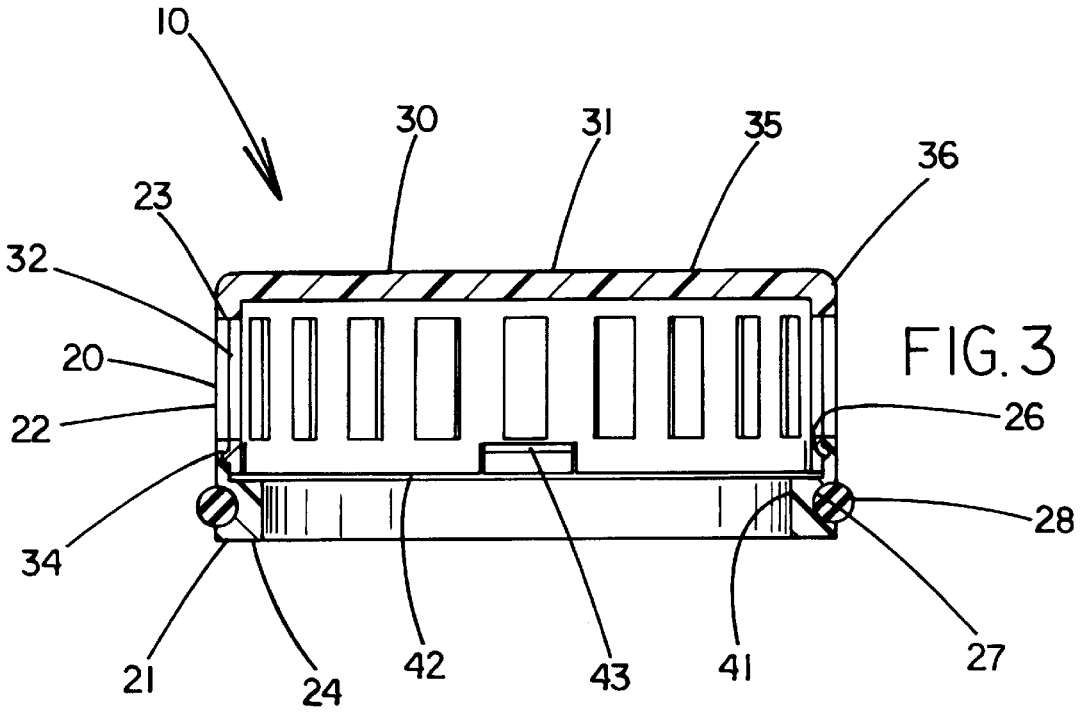
FIG. 3 is a schematic cross-sectional view of the present invention.
Figure 4:
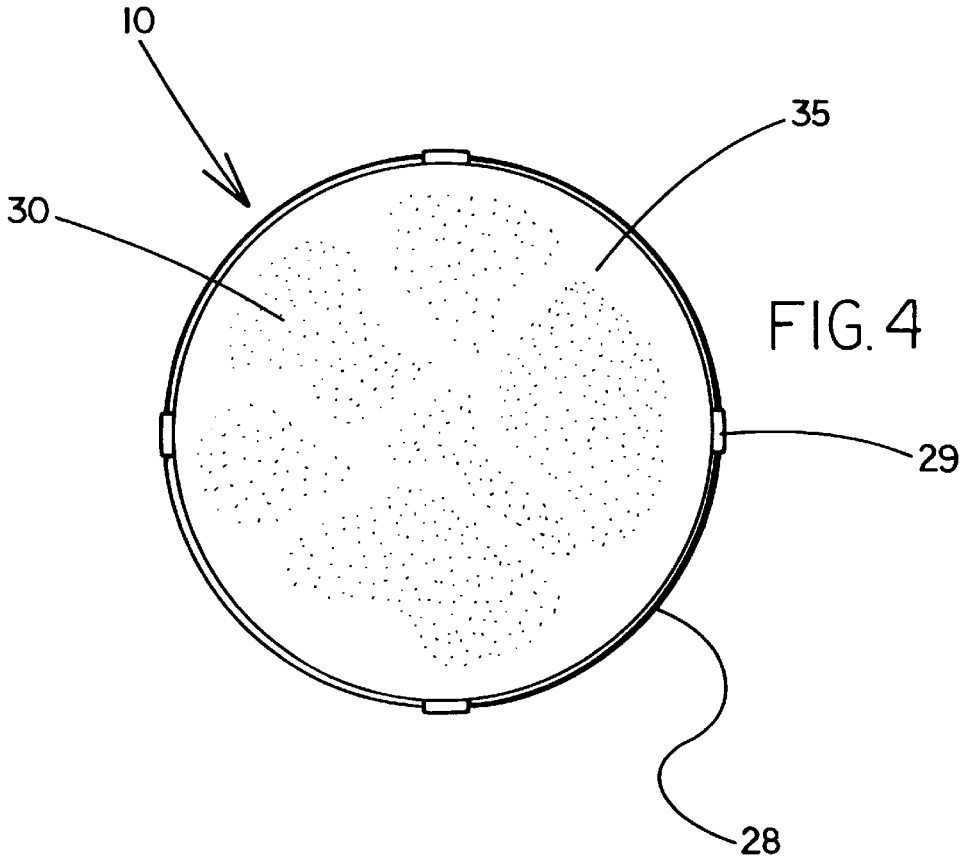
FIG. 4 is a schematic top view of the present invention.

Also preferably, as shown in FIG. 3, the lower portion 21 of the outer housing 20 has a shoulder 41. A generally round screen portion 42 is removably disposed between the shoulder 41 of the lower portion 21 of the outer housing 20 and the inner sidewall 32 of the lid 30. The screen portion 42 is adapted to catch human and animal hair and debris. Ideally, the screen portion 42 has a handle 43 extending from it. Most ideally, the handle 43 has an inverted U-shape. The screen portion 42 may be removed for cleaning by removing the lid 30 from the outer housing 20 and grasping the handle 43 of the screen portion 42 or pushing the screen portion 42 from below.

In an exemplary embodiment, the outer diameter of the drain plug as defined by the outer peripheral edge 36 of the top portion 31 of the lid 30 is between about 2 and 4 inches, ideally about 3 ½ inches, and the distance between the upper surface 35 of the top portion 31 of the lid 30 and the lower end of the outer housing 20 is between about 1 and 2 inches, ideally about ½ inches.

In another exemplary embodiment, the outer diameter of the drain plug as defined by the outer peripheral edge 36 of the top portion 31 of the lid 30 is between about 1 and 2 inches, ideally about 1¼ inches, and the distance between the upper surface 35 of the top portion 31 of the lid 30 and the lower end of the outer housing 20 is between about 1 and 2 inches, ideally about 1¼ inches.

In use, the bottom end 24 of the outer housing 20 is placed in a drain hole until the flanges 29 of the peripheral sidewall 22 of the outer housing 20 abut the drain hole. The lid 30 is rotated to adjust the alignment of the apertures 33 of the lid 30 with the slots 25 of the outer housing 20 until the desired alignment is achieved. To remove the drain stopper 10 from the drain hole, the top portion 31 of the lid 30 is grasped and the drain stopper 10 is pulled out of the drain hole.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drain stopper, comprising an outer housing having a lower portion and a peripheral sidewall extending from said lower portion, said outer housing being adapted for insertion in a drain hole;

said peripheral sidewall of said outer housing having a plurality of slots extending therethrough;

a lid coupled to said outer housing; and wherein said lid comprises a top portion and an inner sidewall downwardly extending from said top portion, said inner sidewall of said top portion being inserted in said peripheral sidewall of said outer housing.

2. The drain stopper of claim 1, wherein said peripheral sidewall of said outer housing slidably receives said inner sidewall of said lid such that said lid is rotatable with respect to said outer housing, said inner sidewall of said lid having a plurality of apertures extending therethrough, said apertures of said inner sidewall of said lid being generally alignable with said slots of said peripheral sidewall of said outer housing, wherein rotation of said lid with respect to said outer housing selectively aligns and misaligns said apertures and said slots.

3. The drain stopper of claim 1, wherein said peripheral sidewall of said outer housing has a groove extending around an inner surface thereof, said inner sidewall of said lid having a peripheral lip extending therearound, said groove of said outer housing receiving said lip of said lid.

4. The drain stopper of claim 1, further comprising a screen portion being disposed between said lower portion of said outer housing and said inner sidewall of said lid, said screen portion being adapted for catching animal hair and debris.

5. The drain stopper of claim 4, wherein said screen portion has a handle extending therefrom.

6. The drain stopper of claim 1, wherein said lower portion of said outer housing has a channel extending therein around an outer surface thereof, an O-ring extending around said lower portion of said outer housing, said O-ring being disposed in said channel of said lower portion of said outer housing, said O-ring being adapted for forming a seal with a drain hole.

7. The drain stopper of claim 1, wherein said peripheral sidewall of said outer housing has a plurality of flanges extending therefrom and adapted for limiting the extent to which said outer housing extends into said drain hole.

8. The drain stopper of claim 7, wherein said outer housing having top and bottom ends, a height of said outer housing being defined between said top and bottom ends thereof, wherein each of said flanges is positioned less than about ½ of said height of said outer housing from said top end of said outer housing.

9. The drain stopper of claim 1, wherein said top portion of said lid has an upper surface, said upper surface being textured for helping reduce slipping of skin along said top portion.

10. The drain stopper of claim 1, wherein an outer peripheral edge of a top portion of said lid lies substantially on a plane extending along an outer surface of said peripheral sidewall of said outer housing.

11. A drain stopper, comprising an outer housing having a generally annular lower portion, a generally cylindrical peripheral sidewall extending from said lower portion, top and bottom ends, and an axis extending between said top and bottom ends, said outer housing being adapted for insertion in a drain hole;

said peripheral sidewall of said outer housing having a plurality of uniformly spaced elongate slots extending therethrough, each of said slots being generally rectangular, each of said slots being oriented generally parallel said axis of said outer housing;

a lid having a generally circular top portion and a generally cylindrical inner sidewall downwardly extending therefrom, said inner sidewall of said lid being slidably insertable in said peripheral sidewall of said outer housing such that said lid is rotatable with respect to said outer housing about said axis of said outer housing;

said inner sidewall of said lid having a plurality of elongate apertures extending therethrough, each of said apertures being generally rectangular;

said apertures of said inner sidewall of said lid being generally alignable with said slots of said peripheral sidewall of said outer housing, wherein rotation of said lid with respect to said outer housing selectively aligns and misaligns said apertures and said slots;

said peripheral sidewall of said outer housing having a groove extending around an inner surface thereof, said inner sidewall of said lid having a peripheral lip extending therearound, said groove of said outer housing receiving said lip of said lid;

said lower portion of said outer housing having a channel extending therein around an outer surface thereof;

an O-ring extending around said lower portion of said outer housing, said O-ring being disposed in said channel of said lower portion of said outer housing, said O-ring being adapted for forming a seal with a drain hole;

said peripheral sidewall of said outer housing having a plurality of flanges extending therefrom and adapted for limiting the extent to which said outer housing extends into said drain hole;

a height of said outer housing being defined between said top and bottom ends thereof, wherein each of said flanges is positioned less than about ½ of said height of said outer housing from said top end of said outer housing;

said top portion of said lid having an upper surface, said upper surface being textured for helping reduce slipping of skin along said top portion;

wherein an outer peripheral edge of said top portion lies substantially on a plane extending along an outer surface of said peripheral sidewall of said outer housing;

said lower portion of the outer housing having a shoulder;

a generally round screen portion being disposed between said shoulder of said lower portion of said outer housing and said inner sidewall of said lid, said screen portion being adapted for catching animal hair and debris; and said screen portion having a handle extending therefrom.

12. A drain stopper, comprising an outer housing having a lower portion and a peripheral sidewall extending from said lower portion, said outer housing being adapted for insertion in a drain hole;

said peripheral sidewall of said outer housing having a plurality of slots extending therethrough;

a lid coupled to said outer housing; and wherein a top portion of said lid has an upper surface, said upper surface being textured for helping reduce slipping of skin along said top portion.

13. The drain stopper of claim 12, wherein said lower portion of said outer housing has a channel extending therein around an outer surface thereof, an O-ring extending around said lower portion of said outer housing, said O-ring being disposed in said channel of said lower portion of said outer housing, said O-ring being adapted for forming a seal with a drain hole.

14. The drain stopper of claim 12, wherein said peripheral sidewall of said outer housing has a plurality of flanges extending therefrom and adapted for limiting the extent to which said outer housing extends into said drain hole.

15. The drain stopper of claim 14, wherein said outer housing having top and bottom ends, a height of said outer housing being defined between said top and bottom ends thereof, wherein each of said flanges is positioned less than about ½ of said height of said outer housing from said top end of said outer housing.

16. The drain stopper of claim 12, wherein an outer peripheral edge of a top portion of said lid lies substantially on a plane extending along an outer surface of said peripheral sidewall of said outer housing.

* * * * *